US007090096B2

(12) United States Patent
Simpson

(10) Patent No.: US 7,090,096 B2
(45) Date of Patent: Aug. 15, 2006

(54) EASEL SHEET DISPENSER

(75) Inventor: Raymond Simpson, Oak Park, IL (US)

(73) Assignee: Menasha Corporation, Neenah, WI (US)

( * ) Notice: Subject to any disclaimer, the term of this patent is extended or adjusted under 35 U.S.C. 154(b) by 136 days.

(21) Appl. No.: 10/848,886

(22) Filed: May 19, 2004

(65) Prior Publication Data

US 2004/0211788 A1 Oct. 28, 2004

Related U.S. Application Data

(63) Continuation-in-part of application No. 10/440,801, filed on May 19, 2003, now Pat. No. 6,851,572, which is a continuation of application No. 10/098,139, filed on Mar. 13, 2002, now Pat. No. 6,564,963, which is a continuation of application No. 09/638,882, filed on Aug. 15, 2000, now Pat. No. 6,367,654, which is a continuation-in-part of application No. 09/130,445, filed on Aug. 6, 1998, now Pat. No. 6,123,221, which is a continuation-in-part of application No. 08/999,846, filed on Oct. 9, 1997, now Pat. No. 5,979,699.

(60) Provisional application No. 60/472,057, filed on May 20, 2003.

(51) Int. Cl.
*A47F 1/04* (2006.01)

(52) U.S. Cl. ..... 221/45; 221/305

(58) Field of Classification Search ..... 221/40, 221/285, 282; 206/459; 248/459
See application file for complete search history.

(56) References Cited

U.S. PATENT DOCUMENTS

| | | | | |
|---|---|---|---|---|
| 2,027,671 A | | 1/1936 | Broeren | |
| 2,237,424 A | | 4/1941 | Hope | |
| 2,251,605 A | * | 8/1941 | Williamson | 248/450 |
| 2,253,742 A | | 8/1941 | West et al. | |
| 4,653,666 A | * | 3/1987 | Mertens | 221/45 |
| 4,993,590 A | | 2/1991 | Windorski | |
| 5,165,570 A | | 11/1992 | Windorski et al. | |
| 5,363,985 A | * | 11/1994 | Cornell | 221/46 |
| 5,390,820 A | | 2/1995 | Wright et al. | |
| 5,979,699 A | | 11/1999 | Simpson | |

FOREIGN PATENT DOCUMENTS

EP 0253308 B1 1/1988

* cited by examiner

*Primary Examiner*—Gene O. Crawford
*Assistant Examiner*—Timothy Waggoner
(74) *Attorney, Agent, or Firm*—Quarles & Brady LLP

(57) ABSTRACT

A promotional display item provides an easel mounted sheet dispenser box, especially one dispensing individually folded coupon. The easel has a display panel supporting itself in an upright position by a base and two side supports. The display panel has an opening in it that aligns with an opening in the front wall of the dispenser box mounted onto the easel base. The sheet dispenser includes an arched member supporting and biasing a stack of sheets toward the openings such that a free end of the outermost sheet protrudes through the openings to facilitate dispensing a single sheet at a time. Preferably, the easel and the dispenser box are each formed from one sheet folded and scored paper blanks.

17 Claims, 4 Drawing Sheets

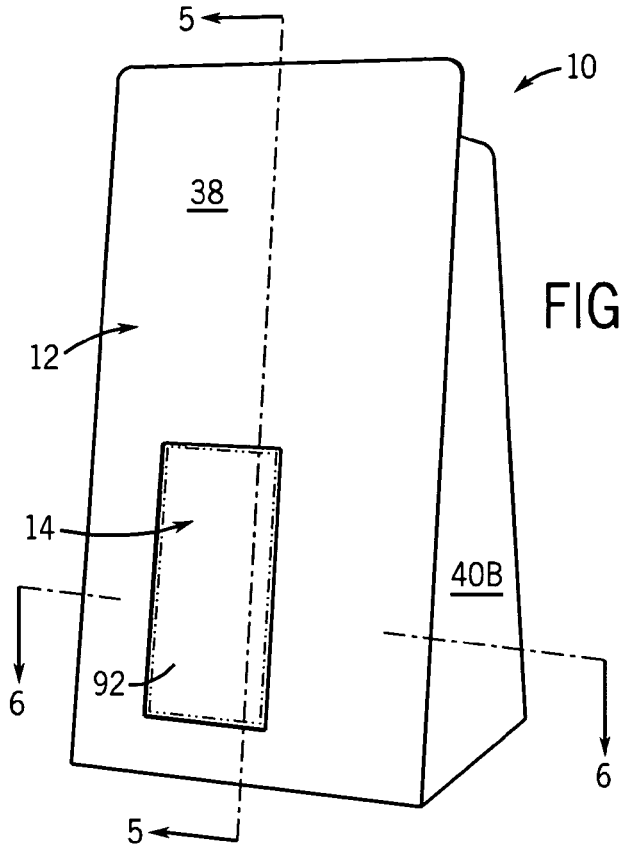
FIG. 1
FIG. 2
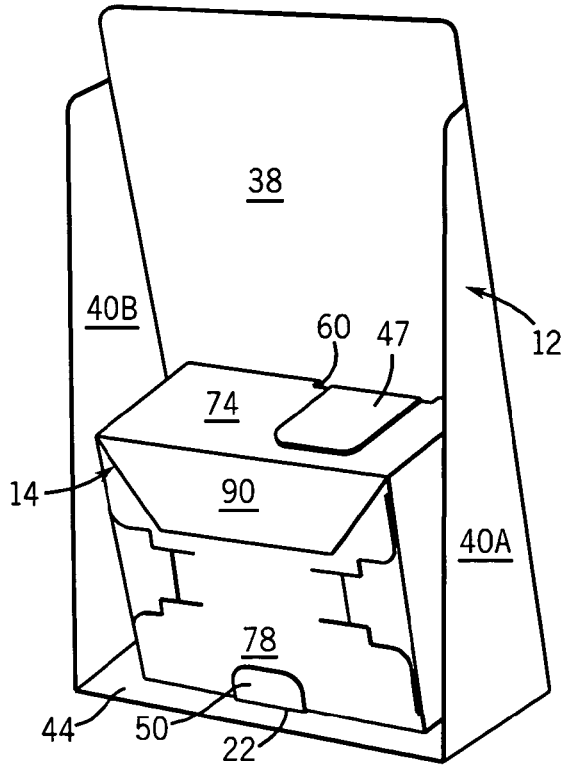

FIG. 3
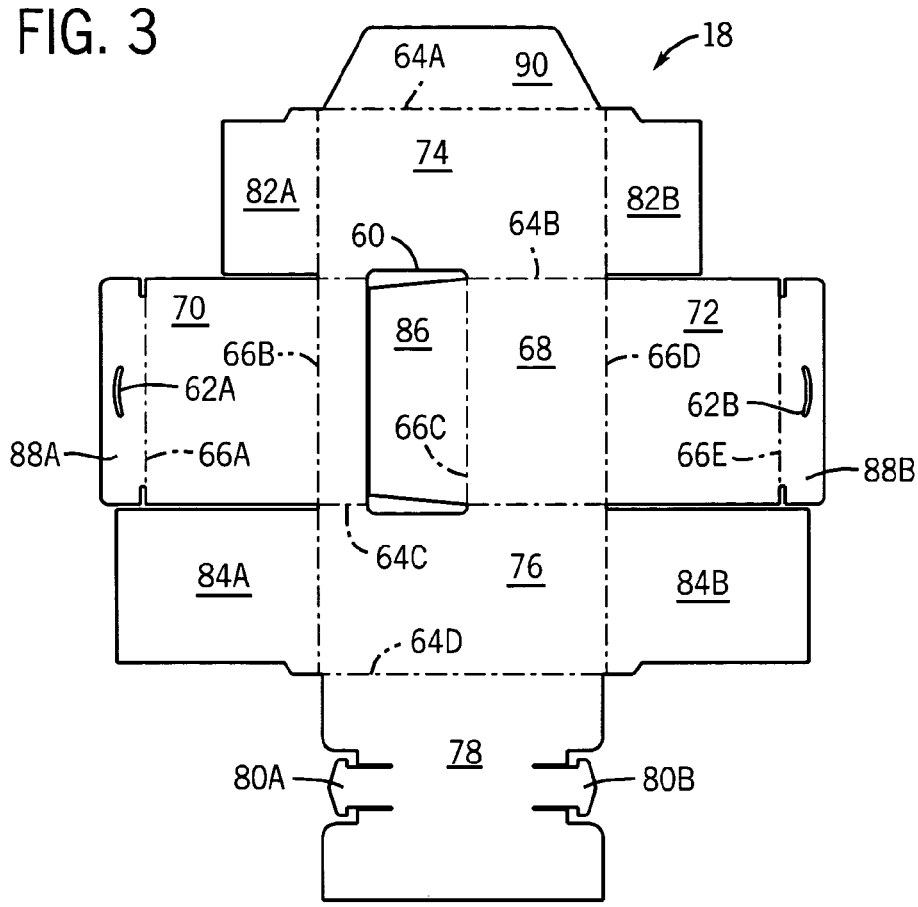
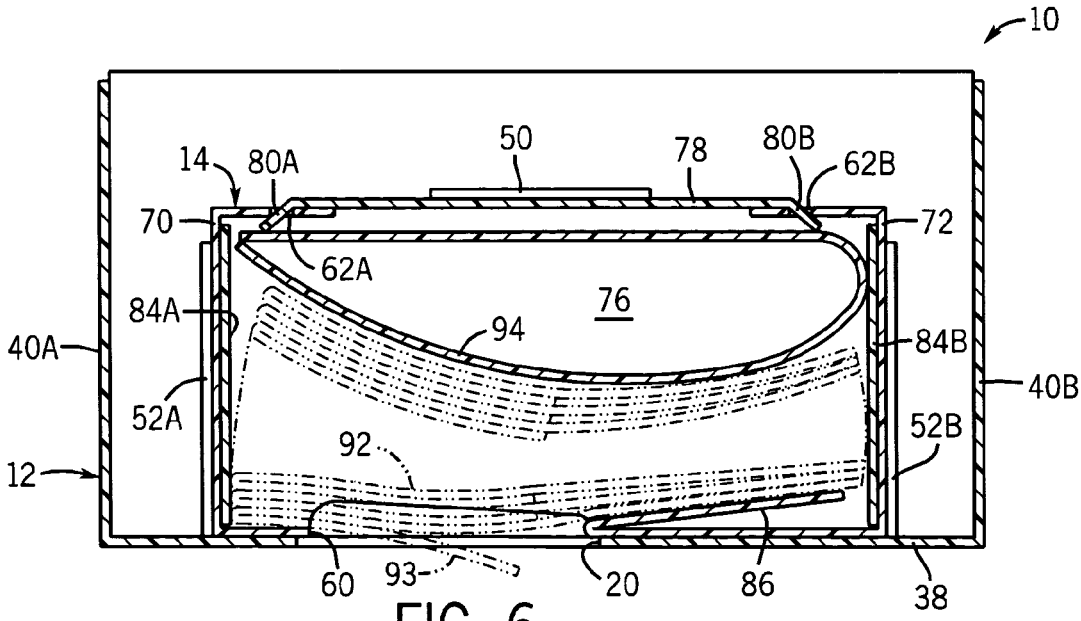
FIG. 6

EASEL SHEET DISPENSER

CROSS-REFERENCE TO RELATED APPLICATION

This application claims the benefit of U.S. provisional application Ser. No. 60/472,057, filed May 20, 2003 and is a continuation-in-part of U.S. application Ser. No. 10/440,801 filed on May 19, 2003, now U.S. Pat. No. 6,851,572, which is a continuation of U.S. application Ser. No. 10/098,139, filed Mar. 13, 2002, now U.S. Pat. No. 6,564,963, which is a continuation of U.S. application Ser. No. 09/638,882, filed Aug. 15, 2000, now U.S. Pat. No. 6,367,654, which is a continuation-in-part of U.S. application Ser. No. 09/130,445, filed Aug. 6, 1998, now U.S. Pat. No. 6,123,221, which is a continuation-in-part of U.S. application Ser. No. 08/999,846, filed Oct. 9, 1997, now U.S. Pat. No. 5,979,699.

STATEMENT OF GOVERNMENT SPONSORED DEVELOPMENT

Not Applicable.

BACKGROUND OF THE INVENTION

This invention relates to promotional items and in particular to retail point of purchase displays.

Various marketing and advertising schemes are used to promote and sell consumer products. One very common technique is to place advertisements in retail outlets near the checkouts or locations where the associated product is displayed for sale. Such point of purchase promotional devices can include signs, samples, product brochures and coupons, all of which are well established as effective such that their use is a matter of routine, at least for certain products and channels of commerce, for example the retail sale of foodstuffs. These devices can be large or small, floor standing, suspended, shelf-mounted or table top items.

Suppliers of food products commonly provide consumers with discounts on certain products, such as newly offered items, in the form of coupons that can be redeemed at the retail outlets for a reduction in the cost of the product. As mentioned, the coupons can be provided to the consumers at the point of purchase as a way of enticing consumers to purchase their products rather than their competitors'.

Manual and automated coupon dispensers have been developed and utilized for dispensing one coupon at a time to the consumer. For example, manual dispenser boxes of the type for dispensing one coupon from a stack of coupons are disclosed in U.S. Pat. Nos. 5,979,699 and 6,367,654 assigned to the assignee of the present invention, which are hereby incorporated by reference as though fully set forth herein. These dispensers include a container holding a stack of the individual coupons, which may be folded and interleaved or not. Some technique for issuing a single coupon at a time may also be incorporated into the dispenser. For example, the containers may also house a spring element to push the coupons toward an access opening so that only the upper or outermost sheet sticks out of the access opening so only it can be easily grasped.

Some of these coupon dispensers, such at that disclosed in U.S. Pat. No. 6,367,654 mentioned above, can have small display panels termed "shouters" on which advertisements and other promotional graphics and text can be printed to draw attention to the associated product and/or the presence of a coupon for the item. However, one problem with such devices is that the display panels may be too small to be significantly eye-catching in certain locations, crowded shelves for example. Another problem is that generally they are not self-supporting and must be mounted to a horizontal support, such as a display shelf.

Thus, an improved promotional item is desired.

BRIEF SUMMARY OF THE INVENTION

The invention provides a promotional display easel having a display panel with an opening therein and at least one support extending at an angle to the panel to maintain the panel in an upright position. A sheet dispenser having walls defining a container with an opening at one side is mounted to the panel so that its opening is aligned with the panel opening.

In one aspect of the invention, the device includes an easel and a sheet dispenser box. The easel has a display panel and a support extending at an angle to the display panel to support it in an upright position at an angle to a supporting surface contacted by the support. The sheet dispenser box is mounted to a display panel support so that an opening in its front wall aligns with the panel opening. The sheet dispenser box further includes an arched member inside its walls supporting a stack of individual sheets and biasing the stack of sheets toward the openings in the sheet dispenser box such that an outermost sheet of the stack of sheets is disposed at the openings in the sheet dispenser box and the easel display panel. Preferably, a free end of an outermost sheet of the stack of sheets protrudes through the openings and is spaced from an adjacent surface of the stack of sheets to facilitate pulling one sheet at a time from the sheet dispenser box.

In other preferred forms the spring or biasing member is an arched member formed by bowing an elongated strip. Each of the easel and the sheet dispenser box components can be formed by folding single sheet scored blanks. Furthermore, preferably the easel support includes a base with projecting tabs that position and retain the dispenser box in place. An adhesive tape can be attached to the dispenser box and a flip back tab at the opening in the easel display panel to better secure the dispenser box.

In another aspect, the invention provides an easel sheet dispenser having a display panel with a front surface for displaying graphics to a customer and a rear surface opposite from the front surface. At least one support extends rearwardly behind the rear surface to support the dispenser on a horizontal surface with the front surface in an upright position. The display panel has an opening therein from the front surface to the rear surface. Behind the opening a stack of sheets is supported and biased toward the display panel. Each sheet has two ends with a fold between the ends. One end and the fold are behind the rear surface of the display panel on opposite sides of the opening and the other free end is aligned with the opening so that the free end of a top sheet has is exposed in the opening for grasping by the customer and pulling to dispense the sheet.

Preferably, the stack of sheets is biased toward a convex shape so that the free end of the top sheet that is aligned with the opening extends forward of the rear surface of the display panel. More preferably, the display panel is formed from one sheet and a box that holds the stack of sheets is formed from another sheet. The easel sheet dispenser is thus formed by affixing the box to the display panel.

The present invention thus provides a unique promotional display item having a broad, self-supporting display panel with a dispenser for dispensing individual coupons or other sheet materials. It presents a sizable display for catching the eye of consumers and while dispensing coupons related to the advertised product. The promotional item can be manufactured economically and requires little assembly.

The advantages of the invention will appear from the following description. In this description, reference is made to the accompanying drawings which form a part hereof and in which there is shown by way of illustration a preferred embodiment of the invention. This embodiment does not represent the full scope of the invention, and thus, the claims should be looked to in order to ascertain the scope of the invention.

BRIEF DESCRIPTION OF THE DRAWINGS

FIG. 1 is front prospective view of an easel sheet dispenser according to the present invention;

FIG. 2 is a rear perspective view thereof;

FIG. 3 is a plan view of a blank for forming a dispenser box component from a single scored paper sheet;

FIG. 6 is an end sectional view taken along line 6—6 of FIG. 1 showing an arched biasing member supporting and biasing a stack of individual sheets toward the access opening in the easel.

DETAILED DESCRIPTION OF THE PREFERRED EMBODIMENT

Figure 4:
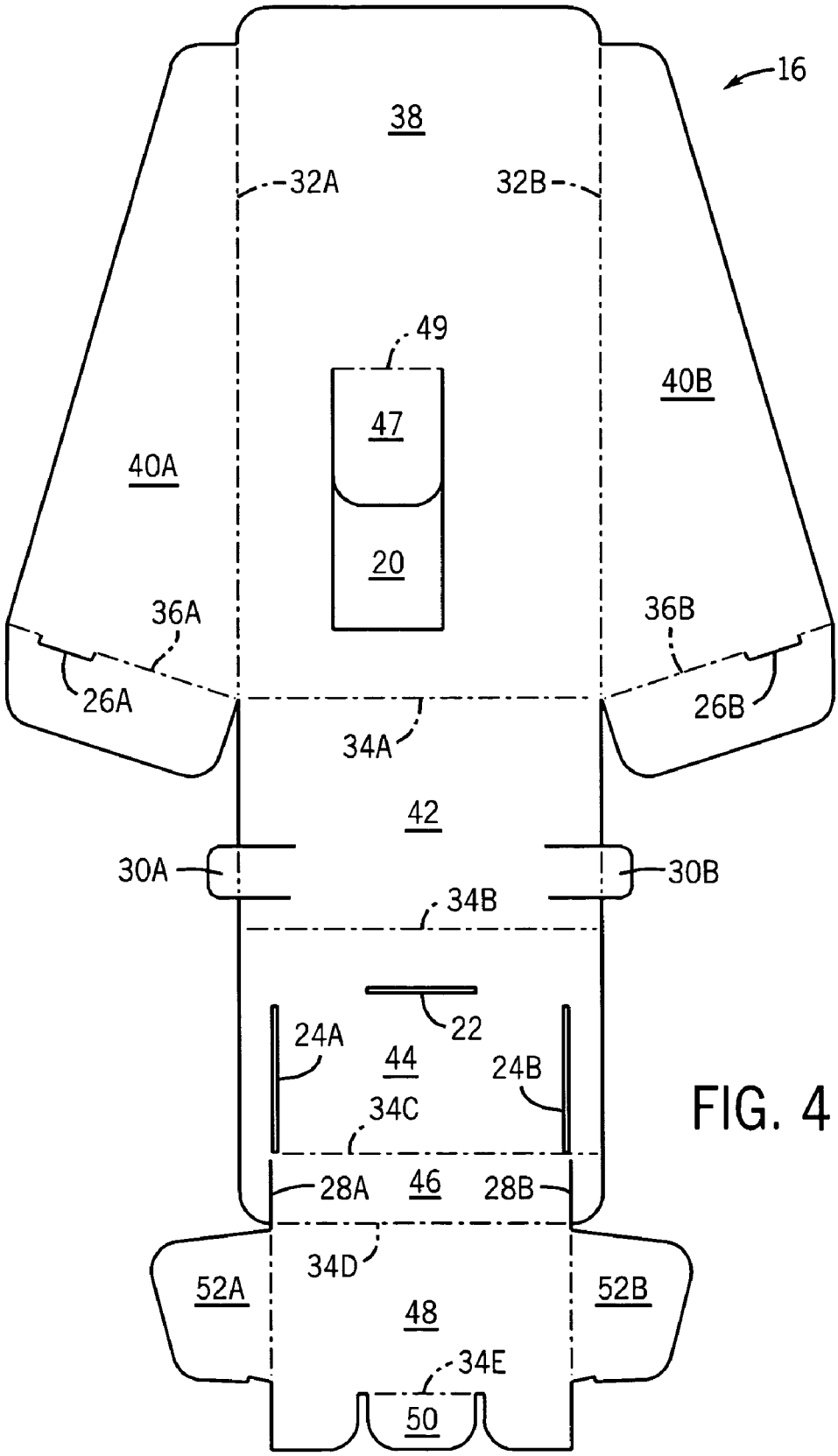
FIG. 4 is a plan view of a blank for forming the easel component from a single scored paper sheet.

FIGS. 1 and 2 illustrate a preferred version of an easel sheet dispenser promotional item 10 according to the present invention. The promotional item 10 includes a display easel 12 mounting a sheet dispenser box 14. As shown in FIGS. 4 and 3, each of these components is folded from a blank 16 and 18, respectively, preferably made of a single sheet of pulp material formed to define a particular periphery, cut outs and fold lines, as shown in the drawings, with opposite front and rear surfaces. After being folded in the constructions described below, the dispenser box 14 is mounted (and preferably adhered) to the easel 12 for use as a table top display and coupon dispensing unit.

With reference to FIGS. 1–2 and 4, the easel 12 is formed of the single sheet blank 16, which is cut from to have the outline shown in FIG. 4. From inside that outline, an access opening 20 as well as a horizontal slot 22 and two vertical slots 24A and 24B are cut out. Through cuts are also made to define slits 26A and 26B, slits 28A and 28B and tabs 30A and 30B. Two vertical 32A and 32B, five horizontal 34A–34E, and two oblique 36A and 36B fold lines are also formed in the blank 16 in the locations shown.

The easel 12 is formed by folding the blank 16 along the fold lines 32, 34 and 36. Doing so defines several panels of the easel 12, including a generally rectangular display panel 38 having the access opening 20 therethrough and opposite front and rear surfaces. Along the lateral sides of the display panel 38 extend generally triangular side supports 40A and 40B, which are used to support the display panel 38 in an upright position, as shown in FIG. 1. Generally rectangular panels 42, 44, 46 and 38 are formed by folding along the horizontal fold lines 34A–34D. A flap 47 is formed by another horizontal fold line 49 at the upper edge of the opening 20.

To form the easel 12, tab 50 is folded about fold line 34E and wings 52A and 52B are folded about respect fold lines 32A and 32B (each being folded into the page of FIG. 4 about 90 degrees). Panels 46 and 48 are each folded (into the page) about respective fold lines 34C and 34D such that tab 50 extends through slot 22 and wings 52A and 52B extend through respective slots 24A and 24B in panel 44. This structure is then folded along fold line 34B (into the page) until panel 48 abuts the underside of panel 42 and then the resulting structure is folded about fold line 34A (into the page) until panel 46 abuts the underside of panel 38. Flaps 54A and 54B are folded (into the page about 90 degrees) about the respective oblique fold lines 36A and 36B and the supports 40A and 40B are then folded (into the page about 90 degrees) along respective fold lines 32A and 32B until the flaps 54A and 54B are disposed between panels 42 and 48 and the supports 40A and 40B abut opposite side edges of the panel 44. Finally, tabs 30A and 30B are folded about respective fold lines 32A and 32B so that they fit up into the respective slits 26A and 26B, and thereby hold the structure together.

Figure 5:
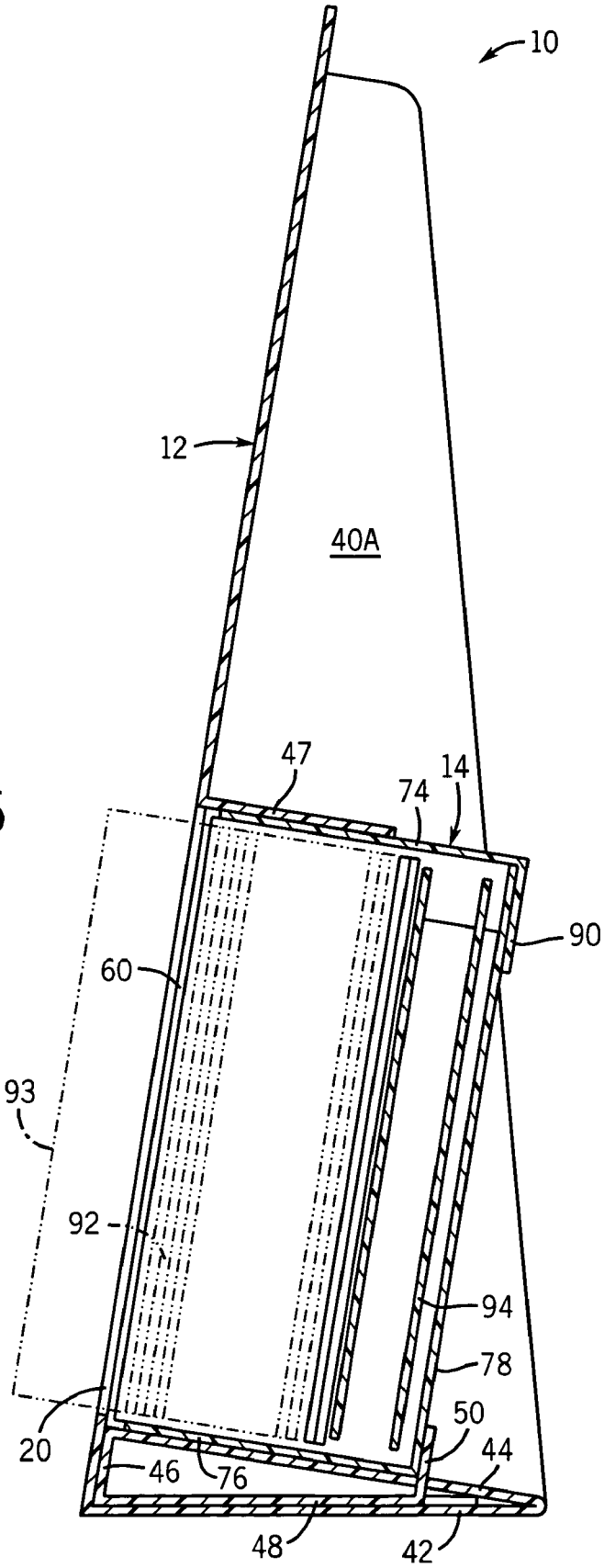
FIG. 5 is a side sectional view taken along line 5—5 of FIG. 1.

As shown in FIG. 5, the display panel 38 of the easel 12 is canted backwards about 20 degrees from vertical, and the panel 44 is at a similar angle such that the included angle, between panels 38 and 44, is about 90 degrees. This is designed to prop the display panel 38 upright at an oblique angle back from vertical suitable to reduce the likelihood of the easel 12 tipping forward off of its base, thereby increasing its stability, and also so that the display panel 38 faces slightly upward such that it is readily viewed when resting on a table top or shelf (at normal heights) by a standing person of average height. The 90 degree included angle between the display panel 38 and base panel 44 is designed to match the generally right angle between the bottom and front faces of the dispenser box 14.

The display panel 38 primarily (but also the side supports 40 to some degree) provides a broad planar surface for containing advertisements or other promotional textual or graphical indicia. Preferably, the display panel 38 (as well as the outer surfaces of the side supports 40) are able to receive ink so that they the promotional indicia can be printed directly onto the blank 16 before assembly. To this end, preferably the blank is made of a suitable thickness paper stock with at least one face (the upper face in FIG. 4) being clay coated. One preferred material is 24 point Carolina coated paper stock.

Referring now to FIG. 3 as well as FIGS. 5 and 6, the sheet dispenser box 14 is formed of the single sheet blank 18, which can also be made of printable paper stock, and which is cut to have the outline shown in FIG. 3 and to define dispenser opening 60 and arcuate slots 62A and 62B. Four horizontal fold lines 64A–D and five vertical fold lines 66A–E are also formed into the blank 18. These fold lines 64 and 66 demarcate a front wall 68 having the dispenser opening 60, left 70 and right 72 side walls, top 74 and bottom 76 walls and a back wall 78 having two pointed tabs 80A and 80B. The vertical fold lines 66 also define flaps 82A and 82B and 84A and 84B as well as center flap 86 at the dispenser opening 60 and end flaps 88A and 88B having the respective arcuate slots 62A and 62B.

The dispenser box 14 is formed by folding walls 70 and 72 along respective fold lines 66B and 66C and walls 74 and 76 along respective fold lines 64B and 64C (generally 90 degrees into the paper of FIG. 3) and then folding back wall 78 along fold line 64D 90 degrees toward wall 74. Flaps 82A and 82B and 84A and 84B fold along respective fold lines 66B and 66C along the inside of respective side walls 70 and 72. End flaps 88A and 88B fold 90 degrees along respective fold lines 66A and 66E along the inside of bottom wall 76 and tabs 80A and 80B are then inserted through the respective arcuate slots 62A and 62B. An outer flap 90 is then folded along fold line 64A and adhered to the outside of the bottom wall 78. The center flap 86 is folded down along fold line 66C to lie back along the underside of wall 68 and fully open the dispenser opening 60.

When folded in this way, the blank 18 forms a six-sided box or container for containing a stack 92 of individual sheets, preferably coupons, each of which is preferably folded in two to have a tab end 93 intermediate opposite ends of each sheet. The stack 92 of sheets is supported by a spring member 94 lying on the bottom of the dispense box 14. The spring member 94 can be a simple elongated rectangular panel bent in two, formed of a suitable material, such as plastic. Bending the plastic panel without creasing into an arched formation creates a spring force in the panel and imparts a bend in the stack 92 of sheets.

As shown in FIGS. 2, 5 and 6, the dispenser box 14 is mounted onto the base of the easel 12 by placing wall 76 of the dispenser box 14 on top of panel 44. Tab 50 and wings 52A and 52B act as positioning walls to both retain and center the dispenser box 14 in the easel 12 such that the dispenser opening 60 aligns with opening 20 of the easel 12. The flap 47 of the easel 12 can be folded back about 90 degrees and affixed to wall 74 of the dispenser box 14, using a suitable adhesive such as double-sided tape, to fully open the easel opening 20 and better secure the dispenser box 14.

The spring member 94 acts as a spring to provide a force biasing the stack 92 of sheets in a convex shape toward the front wall 68 of the dispense box 14 and the display panel 38 of the easel 12 such that the tab end 93 of an outermost sheet protrudes through openings 20 and 86. Preferably, this end is spaced from an adjacent surface of the stack 92 of sheets so that it can be grasped easily to facilitate dispensing sheets one by one. The center flap 86 can assist in the bending of the stack 92 of sheets by virtue of its material resisting bending along file line 66C and thereby applying a slight force against the front/top side of the stack at the non-folded end of the sheets, opposite tab 93, as shown in FIG. 6. This force can be varied by stamping or perforating the fold line 66C to differing depths or not at all.

The present invention thus provides a unique promotional display item having a broad, self-supporting display panel with a dispenser for dispensing individual coupons or other sheet materials. It presents a sizable display for catching the eye of consumers and can dispense coupons that relate to the advertisement on the display. The promotional item can be manufactured economically and requires little assembly.

While there has been shown and described what is at present considered to be the preferred embodiment of the invention, it will be obvious to those skilled in the art that various changes and modifications can be made to the described device without departing from the scope of the present invention. Accordingly, to ascertain the full scope of the invention, reference must be had to the following claims.

What is claimed is:

1. A promotional display easel, comprising:

a display panel having a front side with an opening extending therethrough to a back side and at least one support extending at an angle to the panel to maintain the panel in an upright position; and a sheet dispenser having walls defining a container with an opening at one side, a perimeter defined by said side, the sheet dispenser being mounted at the back side of the panel so that its opening is aligned with the panel opening and the perimeter is hidden by the panel from the front side of the panel.

2. The display easel of claim 1, wherein the sheet dispenser includes a biasing member within the walls and adapted to provide a force acting in the direction of the opening.

3. The display easel of claim 2, wherein the biasing member is an arched member.

4. The display easel of claim 1, wherein the display panel is formed from a single sheet.

5. The display easel of claim 1, wherein the sheet dispenser is formed from a single sheet.

6. The display easel of claim 1, wherein the display panel has two supports, one extending back at essentially 90 degrees from each of opposite sides.

7. The display easel of claim 6, wherein the display panel has a base extending back form a bottom of the display panel.

8. The display easel of claim 7, wherein the base defines a retainer for positioning the sheet dispenser.

9. The display easel of claim 8, wherein the base is joined to the side supports.

10. The display easel of claim 9, wherein the display panel is made of a single sheet including the side supports and the base.

11. The display easel of claim 1, wherein the sheet dispenser has a pivotal front wall in part defining the opening of the sheet dispenser and being adhered to a surface of the sheet dispenser.

12. The display easel of claim 1, wherein the sheet dispenser includes an arched member supporting a stack of individual sheets and biasing the stack of sheets toward the opening in the sheet dispenser such that a free end of an outermost sheet of the stack of sheets is disposed through the openings in the sheet dispenser and the display panel.

13. The display easel of claim 12, wherein the free end of the outermost sheet is spaced from an adjacent surface of the stack of sheets.

14. A promotional display item, comprising:

an easel having a display panel and a support extending from the display panel to support it in an upright position at an angle to a supporting surface contacted by the support, the display panel having a front side with an opening extending therethrough to a back side; and a sheet dispenser box having a wall defining a container including a front wall defining a perimeter and an opening and aligned with the opening of the easel display pane, the sheet dispenser box being mounted at the back side of the display panel so the perimeter is hidden from the front side of the panel, wherein the sheet dispenser box includes an arched member within the walls supporting a stack of individual sheets and biasing the stack of sheets toward the opening in the sheet dispenser box such that an outermost sheet of the stack of sheets is disposed at the openings in the sheet dispenser box and the easel display panel.

15. An easel sheet dispenser having a display panel with a front surface for displaying graphics to a customer and a rear surface opposite from the front surface and at least one support extending rearwardly behind the rear surface to support the dispenser on a horizontal surface with the front surface in an upright position, and wherein the display panel has an opening therein from the front surface to the rear surface, and wherein behind the opening a stack of sheets is supported and biased toward the display panel, each sheet having two free ends with a fold between the free ends, one free end and the fold being behind the rear surface of the display panel on opposite sides of the opening and the other free end being aligned with the opening so that the other free end of a top sheet has its other free end exposed in the opening for grasping by the customer and pulling to dispense the sheet.

16. An easel sheet dispenser as in claim 15, wherein the stack of sheets is biased toward a convex shape so that the free end of the top sheet that is aligned with the opening extends forward of the rear surface of the display panel.

17. An easel sheet dispenser as in claim 16, wherein the display panel is formed from one sheet, a box that holds the stack of sheets is formed from another sheet, and the box and display panel are affixed to one another to form the easel sheet dispenser.

* * * * *

UNITED STATES PATENT AND TRADEMARK OFFICE

CERTIFICATE OF CORRECTION

PATENT NO. : 7,090,096 B2
APPLICATION NO. : 10/848886
DATED : August 15, 2006
INVENTOR(S) : Raymond Simpson It is certified that error appears in the above-identified patent and that said Letters Patent is hereby corrected as shown below:

Col. 6, Line 47, Claim 14, change “display pane,” to --display panel,--.

Signed and Sealed this

Sixth Day of March, 2007

JON W. DUDAS
*Director of the United States Patent and Trademark Office*